US011584565B1

(12) United States Patent
Jarratt

(10) Patent No.: US 11,584,565 B1
(45) Date of Patent: Feb. 21, 2023

(54) COLLAPSIBLE CONTAINER

(71) Applicant: Hugh Mills Jarratt, Fayetteville, AR (US)

(72) Inventor: Hugh Mills Jarratt, Fayetteville, AR (US)

( * ) Notice: Subject to any disclaimer, the term of this patent is extended or adjusted under 35 U.S.C. 154(b) by 188 days.

(21) Appl. No.: 16/795,436

(22) Filed: Feb. 19, 2020

Related U.S. Application Data

(60) Provisional application No. 62/807,524, filed on Feb. 19, 2019.

(51) Int. Cl.
*B65D 21/08* (2006.01)

(52) U.S. Cl.
CPC ..... *B65D 21/086* (2013.01)

(58) Field of Classification Search
CPC ... B65D 7/26; B65D 7/20; B65D 7/28; B65D 11/1846; B65D 11/1806; B65D 21/086; B65D 5/3685
See application file for complete search history.

(56) References Cited

U.S. PATENT DOCUMENTS

| | | | | |
|---|---|---|---|---|
| 4,648,034 A * | 3/1987 | Heninger | G06F 12/0802 710/110 |
| 9,120,600 B1 * | 9/2015 | Bubilek | B65D 11/1846 |
| 10,602,860 B2 * | 3/2020 | Clark | A47F 5/114 |
| 2019/0161235 A1 * | 5/2019 | Lu | B65D 7/32 |

FOREIGN PATENT DOCUMENTS

| | | |
|---|---|---|
| GB | 178787 | * 4/1922 |
| GB | 693235 | * 6/1953 |

* cited by examiner

*Primary Examiner* — Anthony D Stashick
*Assistant Examiner* — Blaine G Neway
(74) *Attorney, Agent, or Firm* — Schrantz Law Firm, PLLC; Stephen D. Schrantz

(57) ABSTRACT

The collapsible container is constructed from semi-rigid to rigid wall panels, such as eight panels, that are held together by fasteners that allow the wall panels to be folded in multiple manners while remaining attached. When in use, the eight panels form side walls, a front wall, a rear wall, and a bottom floor of a basket or container that are attached and rigid. The rigid walls and floor of the container secures, holds, and supports items within the container. When fully opened and ready for use, the bottom panels of the floor are connected to the side wall panels by at least one rigid hook shaped fastener, including two fasteners. When fully collapsed, the eight rigid panels fold so that all eight panels are stacked immediately upon one another.

1 Claim, 10 Drawing Sheets

COLLAPSIBLE CONTAINER

CROSS-REFERENCE TO RELATED APPLICATIONS

This application claims priority to and is a continuation in part of U.S. Patent Application No. 62/807,524 filed on Feb. 19, 2019 entitled "Collapsible Container" which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The present invention relates to a collapsible container. More specifically, the present invention relates to a container that collapses and folds both vertically and horizontally to reduce the cubic area of the container when not in use.

II. Background of the Invention

Containers are utilized for many uses and are available in many sizes. However, a common problem exists in that containers take up too much space when not in use. The present invention reduces the size of the container when not in use.

By folding both the container walls and floor and utilizing a certain folding pattern, the container collapses to a mere fraction of the usable cubic size when in storage.

SUMMARY OF THE INVENTION

The present invention is constructed from semi-rigid to rigid wall panels, such as eight panels, that are held together by fasteners that allow the wall panels to be folded in multiple manners while remaining attached. When in use, the eight panels form side walls, a front wall, a rear wall, and a bottom floor of a basket or container that are attached and rigid. The rigid walls and floor of the container secures, holds, and supports items within the container. When fully opened and ready for use, the bottom panels of the floor are connected to the side wall panels by at least one rigid hook shaped fastener, including two fasteners. When fully collapsed, the eight rigid panels fold so that all eight panels are stacked immediately upon one another.

It is an object of the present invention to provide a rigid container.

It is another object of the present invention to provide a rigid container that collapses to a smaller footprint.

It is another object of the present invention to provide a unique collapsible system that decreases the footprint of the container when not in use.

It is another object of the present invention to pivotally attach the side walls to each other to collapse the container.

It is another object of the present invention to pivotally attach the floor of the container to the front wall and the rear wall to collapse the container.

It is another object of the present invention to provide a fastener that releasably secures the side walls to the floor to collapse the container.

These and other objects and advantages of the present invention, along with features of novelty appurtenant thereto, will appear or become apparent by reviewing the following detailed description of the invention.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
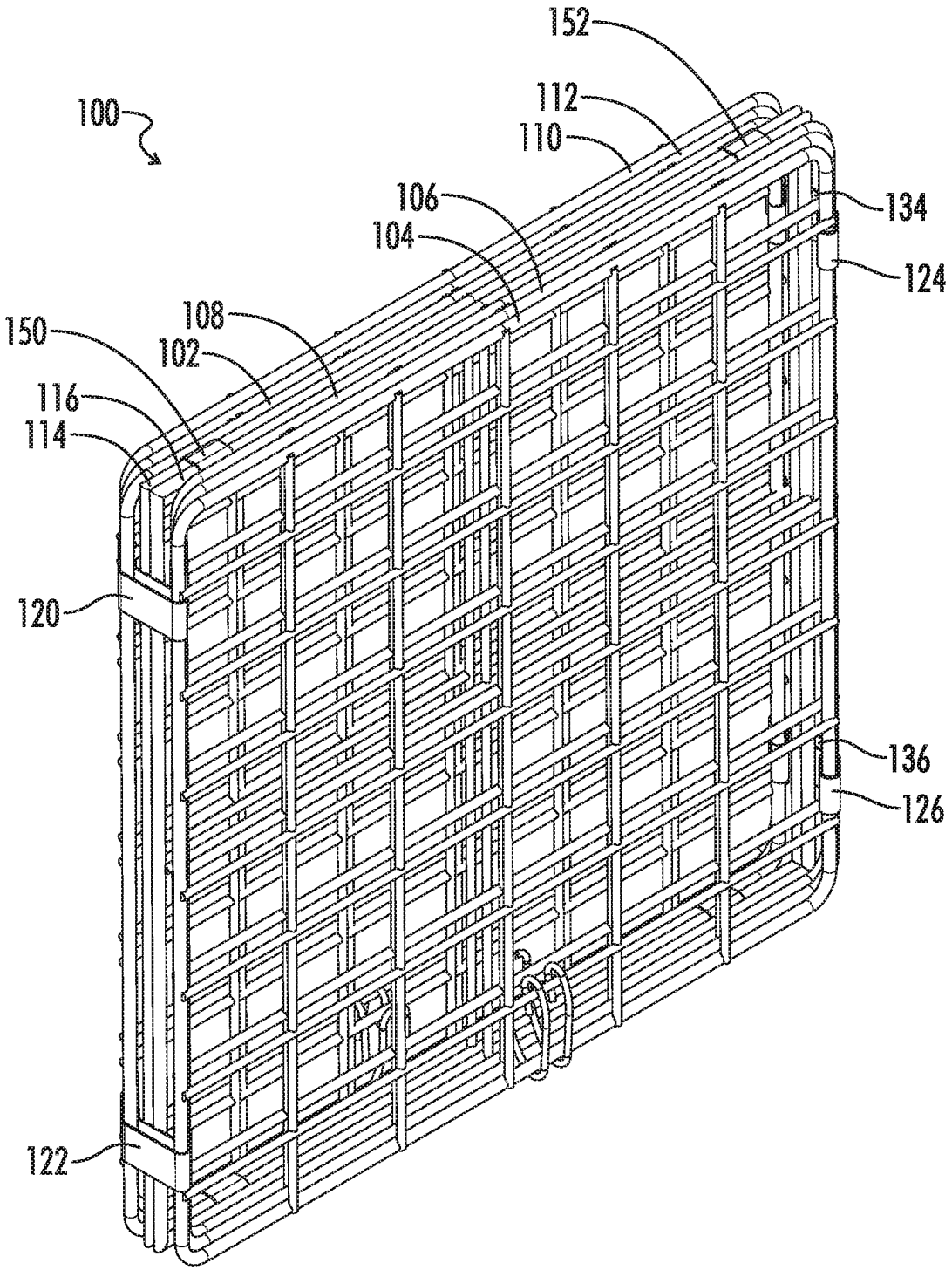
FIG. 1 is a perspective view of one embodiment of the present invention.

FIG. 1 shows one embodiment of the present invention generally shown as container 100. FIG. 1 shows the container folded and not in use. The container 100 collapses to minimize the footprint of the container 100.

Many individuals have a need for containers to hold or transport loose items such as laundry, toys, or groceries. However, when not being used to hold or transport loose items, these containers occupy a large amount of cubic space.

The present invention allows for a large variation of cubic space differential between the container when configured for use and when configured for storage.

The present invention is constructed from panels that attach together with certain fasteners to form sides and a floor of a container when fastened together.

The present invention has three types of fasteners, that when used together allow the container to be folded into the "in-use" configuration and the "storage" configuration. One type of fastener holds the panels immediately adjacent to one another. One type of fastener holds the panels together but forces the panels to remain a certain distance apart. One type of fastener connects the side wall panels to the floor panels to prevent the container from folding when in use.

Figure 2A:
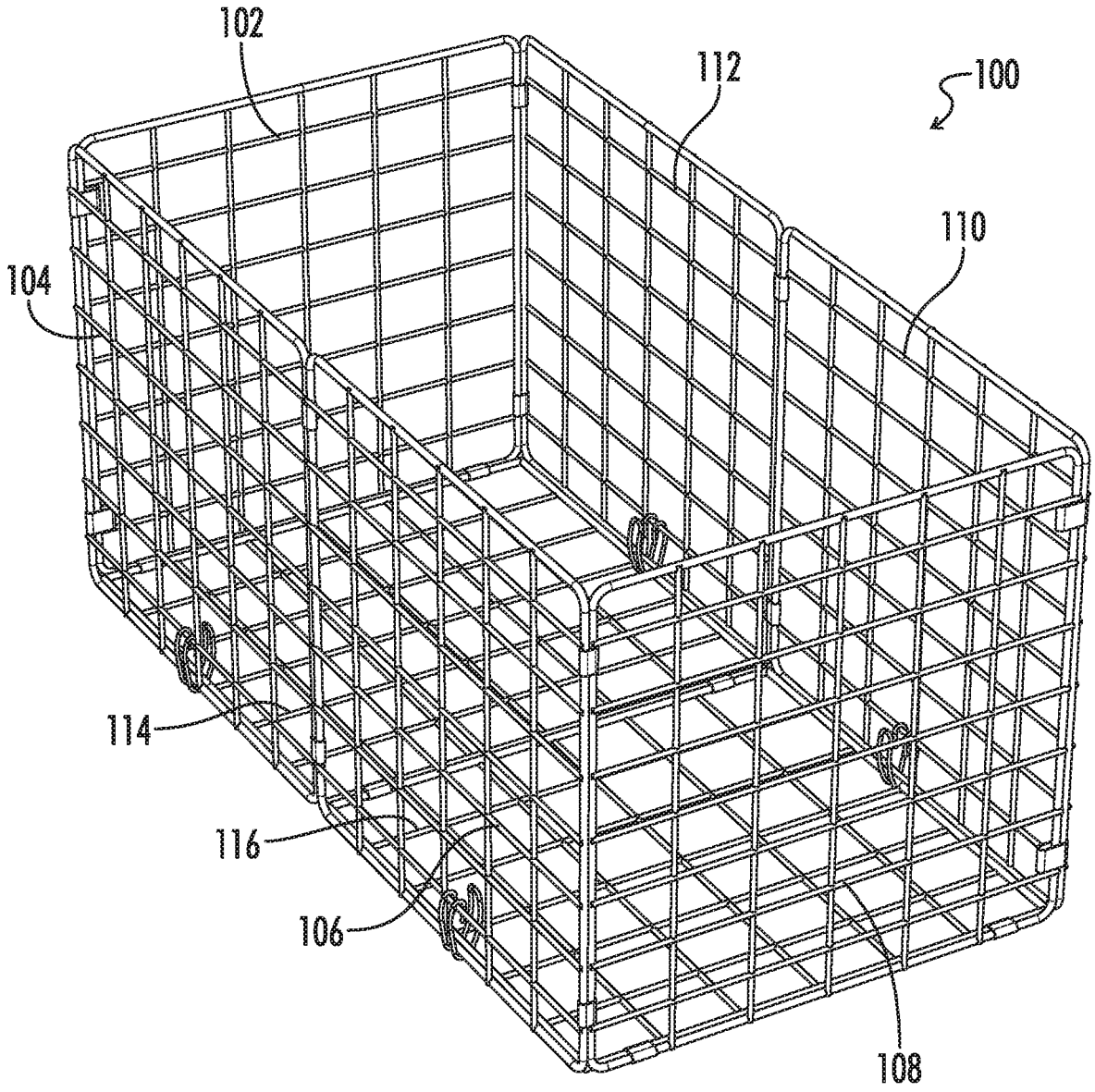
FIG. 2A is a perspective view thereof.
Figure 2B:
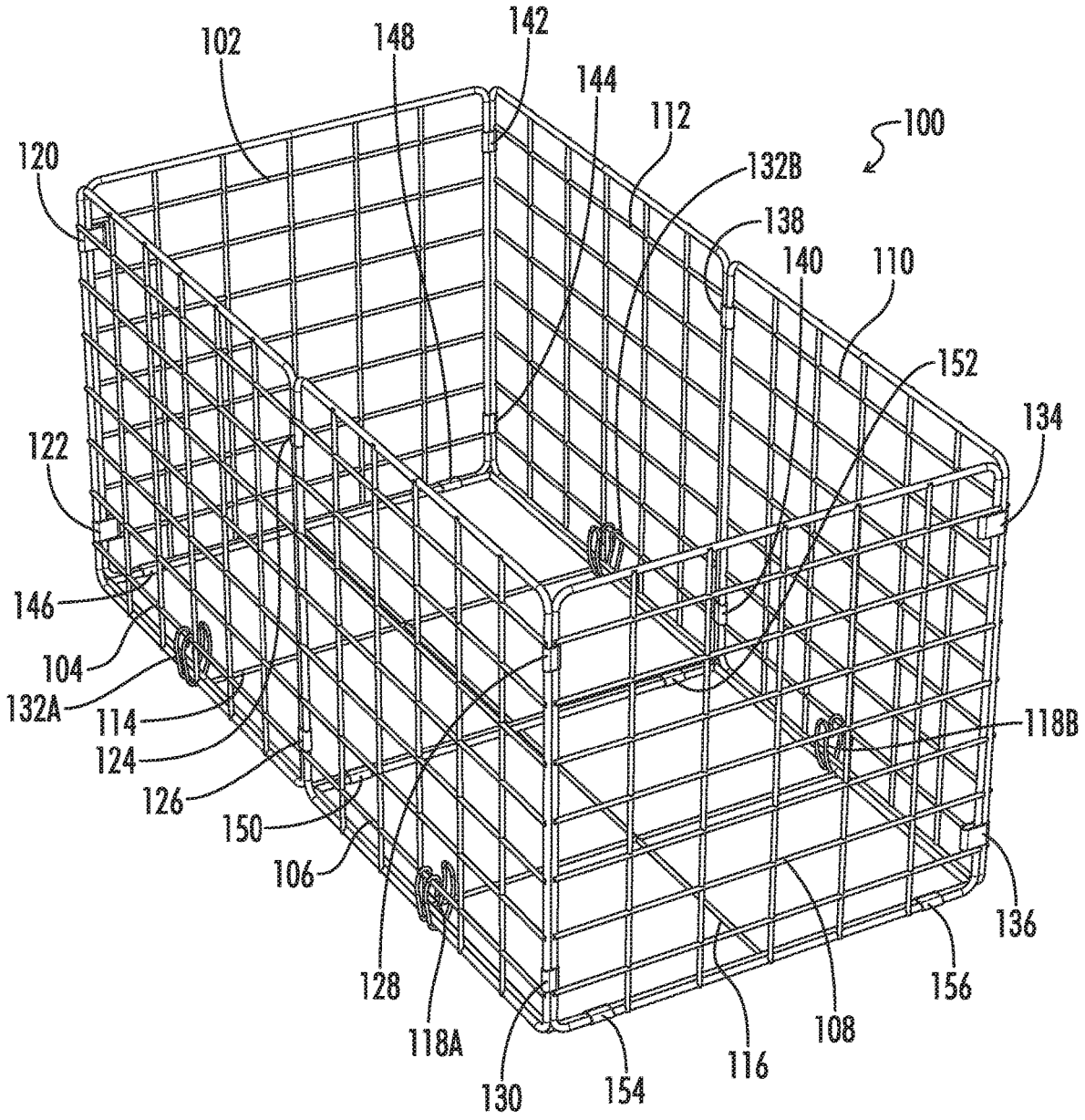
FIG. 2B is a perspective view thereof.

FIGS. 2A and 2B show the container folded into the "in-use" configuration. FIG. 2A shows the floor panels 114, 116 having a similar grid pattern as front wall 108, rear wall 102, first right side wall 110, second right side wall 112, first left side wall 106, and second left side wall 104. The walls and floor panels may provide a solid surface, a grid like surface with a wire frame, or other type of wall and panel. The number of bars forming the grid pattern of the floor panels 114, 116 has been reduced in FIGS. 1 and 2B-11 to better show the numbering and reference lines of the Figures. The floor panels 114, 116 shown in FIGS. 1, 2B-11 can include the grid pattern having shown on the side walls, the front wall, and the rear wall.

The container 100 provides a front wall 108, rear wall 102, side walls 104, 106, 110, 112, and floor panels 114, 116. Fasteners 120, 122, 134, 136 allow stretch so that the container folds flat when not in use. Fasteners 134, 136 pivotally attach the front wall 108 to side wall 110. Fasteners 120, 122 pivotally attach the rear wall 102 to side wall 104. Fasteners 120, 122, 134, 136 are positioned opposite on walls 102, 108.

Fasteners 124, 126, 128, 130, 138, 140, 142, 144, 146, 148, 150, 152, 154, 156 are rigid and position the other walls and floor panels. Fasteners 154, 156 secure floor panel 116 to front wall 108. Fasteners 146, 148 secure rear wall 102 to floor panel 114. Fasteners 150, 152 secure floor panel 114 to floor panel 116. Fasteners 142, 144 secure rear wall 102 to second right wall 112. Fasteners 138, 140 secure wall 112 to first right wall 110. Fasteners 128, 130 secure front wall 108 to first left wall 106. Fasteners 124, 126 secure wall 106 to second left wall 104.

Figure 3:
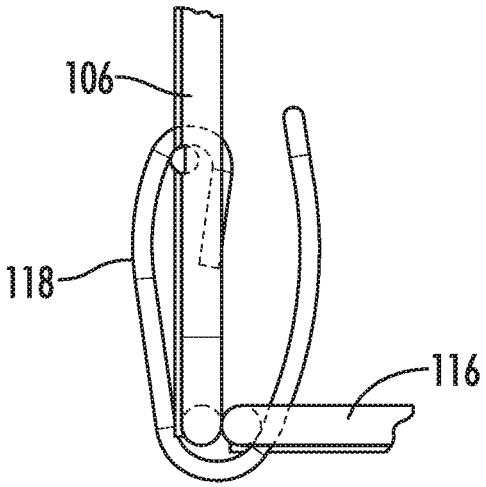
FIG. 3 is a side view of a portion of one embodiment of the present invention.
Figure 4A:
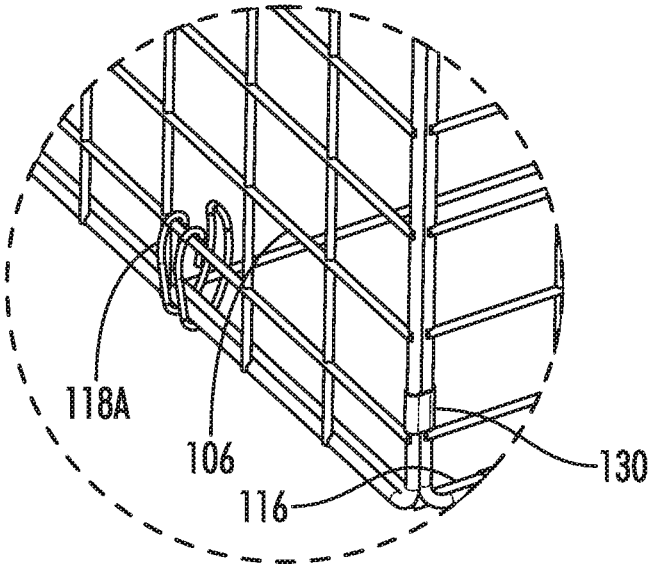
FIG. 4A is a perspective view of a portion of one embodiment of the present invention.
Figure 4B:
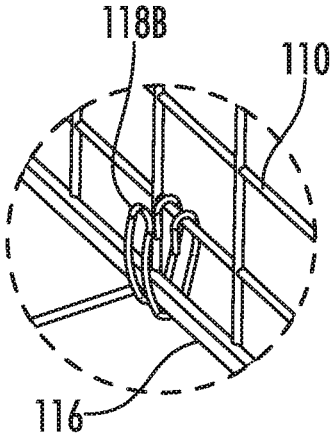
FIG. 4B is a perspective view of a portion of one embodiment of the present invention.

FIGS. 3, 4A, and 4B show one embodiment of a fastener 118 that attaches the side wall 106 to the floor panel 116. Fastener 118 maintains the container in its "in-use" configuration. Fastener 118 adjusts to allow the container to fold together when not in use. The fastener 118 adjusts to a position that does not interfere with altering or folding of the container.

The attachment finger 118 is similar to attachment fingers 118A, 118B, 132A, and 132B. Attachment fingers 118A, 118B, 132A, 132B attach to the side wall, such as wall 104, 106, 110, 112. Attachment fingers 118A, 118B, 132A, 132B pivot in relation to the wall. The attachment finger inserts into floor panel, such as floor panel 114, 116. The attachment finger curves upward to secure the floor panel with the attachment finger and the side wall.

Figure 5:
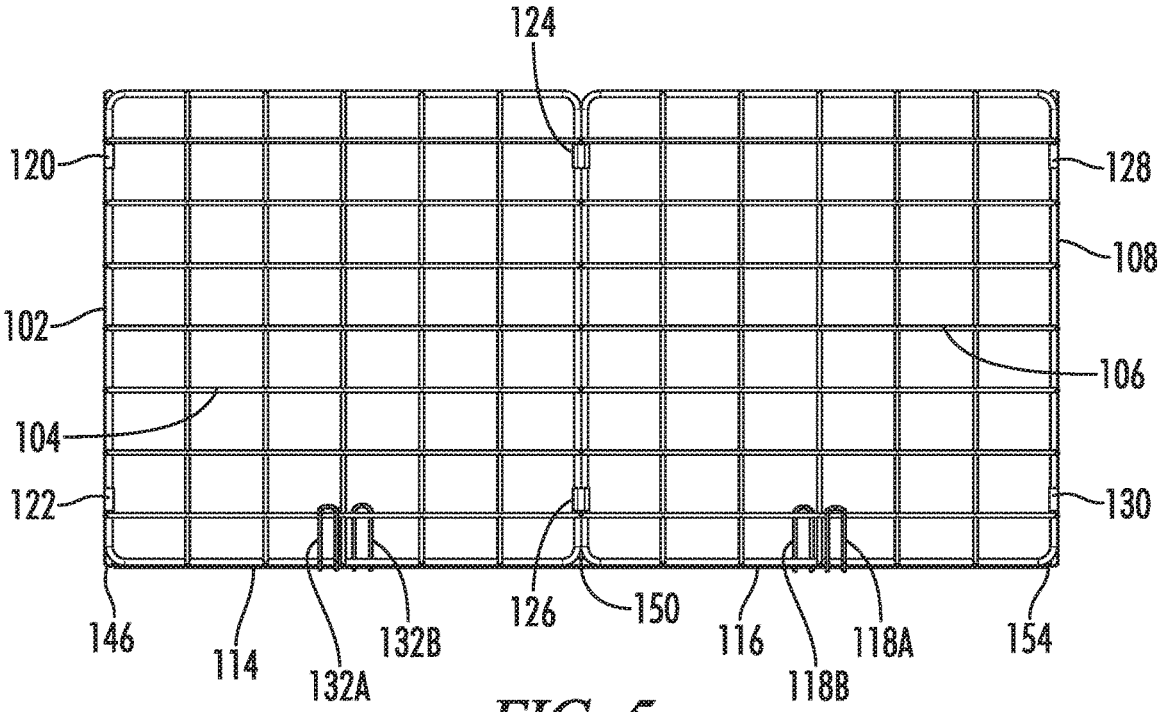
FIG. 5 is a left side view of one embodiment of the present invention.
Figure 6:
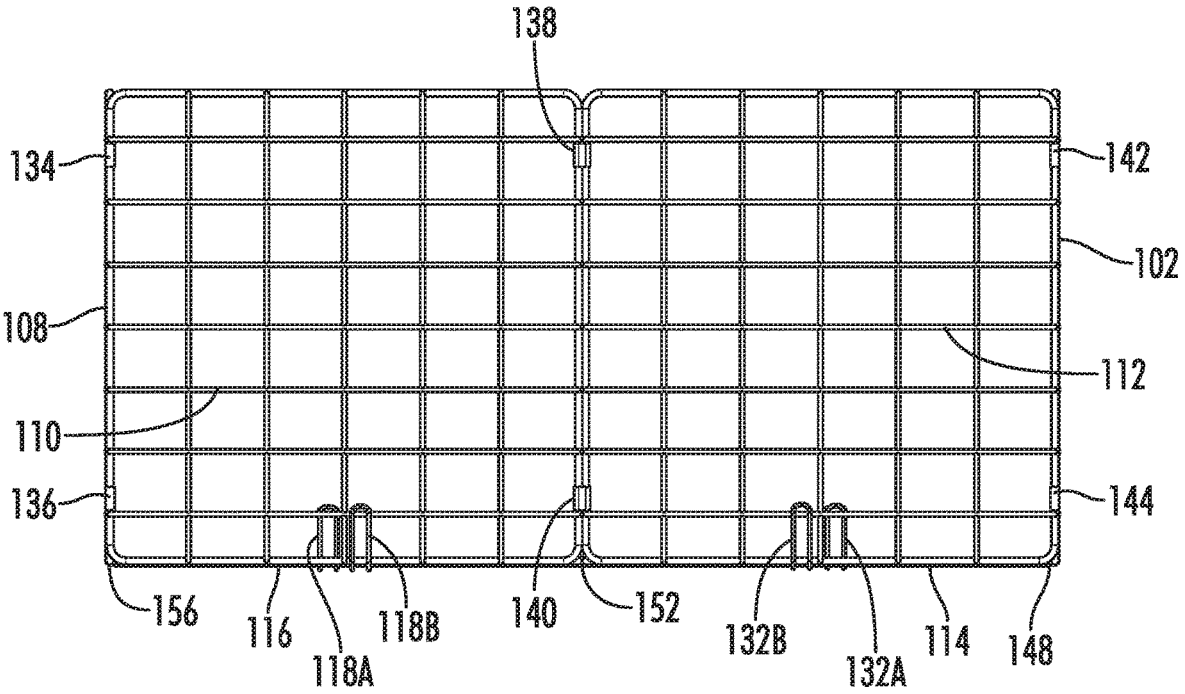
FIG. 6 is a right side view thereof.
Figure 7:
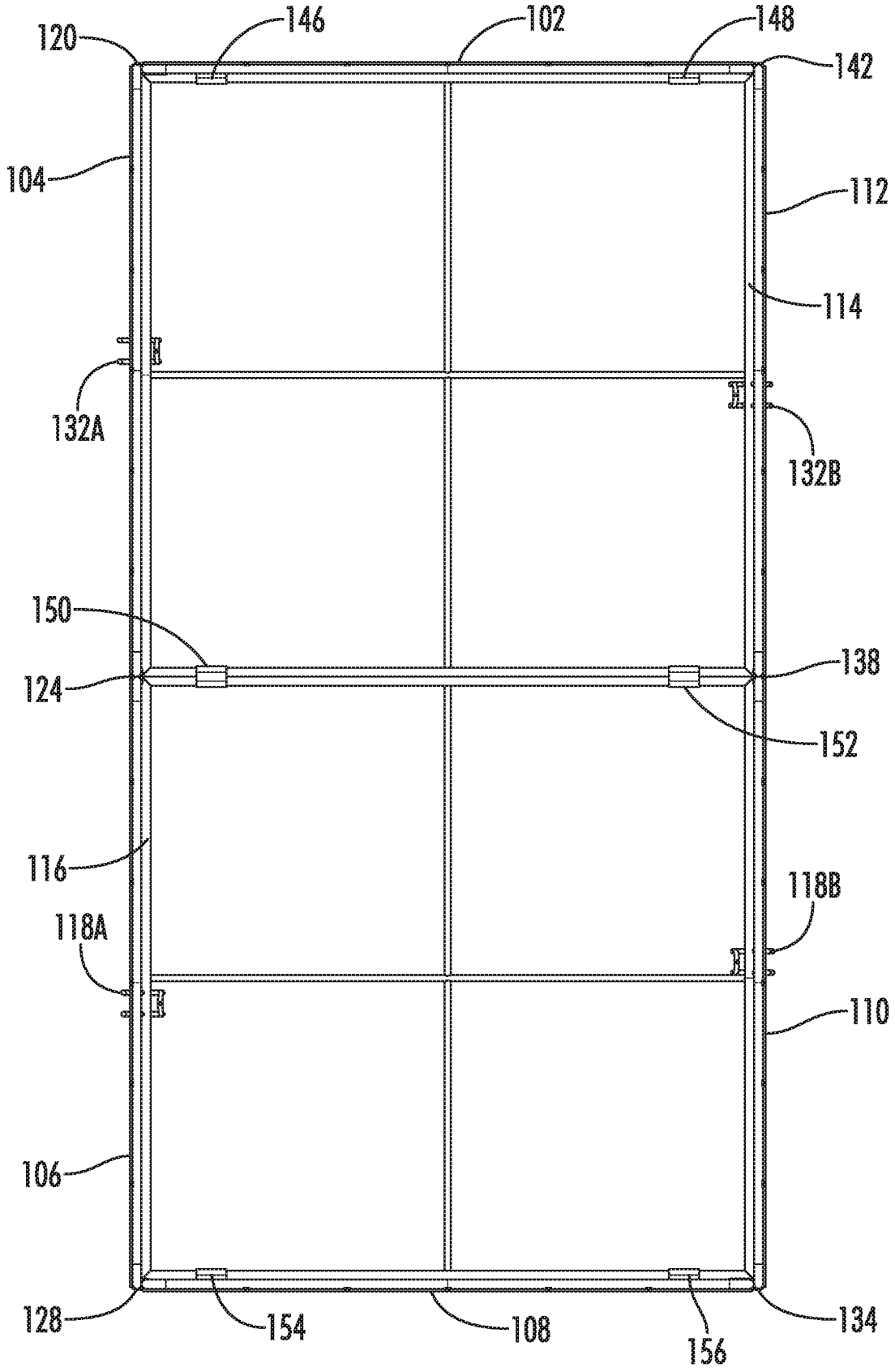
FIG. 7 is a top view thereof.

FIGS. 5-7 show the container in the use position. Side walls 104, 106 pivotally attach to each other. Fasteners 124, 126 pivotally attach the side walls 104, 106 to each other. Side wall 106 attaches to front wall 108 via fasteners 128, 130. Side wall 104 attaches to rear wall 102 via fasteners 120, 122. Fasteners 120, 122, 124, 126, 128, 130 pivotally secure the walls to each other. Fasteners 120, 122 serve as a movement joint that allows some movement of the walls toward and away from each other in addition to the pivot. Such movement allows the walls to collapse. Fasteners 124, 126, 128, 130 pivotally secure the walls to each other without allowing the movement of the panels in relation to each other as fasteners 120, 122.

Side walls 104, 106 do not directly attach to the floor panels 114, 116. Side walls 104, 106 indirectly attach to the floor panels 114, 116 via the attachment to the front wall 108 and rear wall 102.

Front wall 108 attaches to floor panel 116. Fastener 154 secures the front wall 108 to the floor panel 116. Fastener 154 pivotally attaches the front wall 108 to the floor panel 116. Rear wall 102 attaches to floor panel 114. Fastener 146 secures the rear wall 102 to the floor panel 114. Fastener 146 pivotally attaches the rear wall 102 to the floor panel 116. Fasteners 146, 154 pivotally attach the floor panels 114, 116 to the rear wall 102 and the front wall 103. Fasteners 146, 154 of one embodiment limit the movement of the panels of the rear wall and front wall with the floor panels to pivoting. Fasteners 146, 154 restrict movement of the walls with the floor more than fasteners 120, 122.

FIG. 6 shows the container in the use position. Side walls 110, 112 pivotally attach to each other. Fasteners 138, 140 pivotally attach the side walls 110, 112 to each other. Side wall 110 attaches to front wall 108 via fasteners 134, 136. Side wall 112 attaches to rear wall 102 via fasteners 142, 144. Fasteners 134, 136, 138, 140, 142, 144 pivotally secure the walls to each other. Fasteners 134, 136 serve as a movement joint that allows some movement of the walls toward and away from each other in addition to the pivot. Such movement allows the walls to collapse. Fasteners 138, 140, 142, 144 pivotally secure the walls to each other without allowing the movement of the panels in relation to each other as fasteners 134, 136.

Side walls 110, 112 do not directly attach to the floor panels 114, 116. Side walls 110, 112 indirectly attach to the floor panels 114, 116 via the attachment to the front wall 108 and rear wall 102.

As shown in FIGS. 5-7, front wall 108 attaches to floor panel 116. Fasteners 154, 156 secure the front wall 108 to the floor panel 116. Fasteners 154, 156 pivotally attach the front wall 108 to the floor panel 116. Rear wall 102 attaches to floor panel 114. Fasteners 146, 148 secure the rear wall 102 to the floor panel 114. Fasteners 146, 148 pivotally attach the rear wall 102 to the floor panel 116. Fasteners 146, 154 pivotally attach the floor panels 114, 116 to the rear wall 102 and the front wall 103. Fasteners 146, 148, 154, 156 of one embodiment limit the movement of the panels of the rear wall and front wall with the floor panels to pivoting. Fasteners 124, 126, 128, 130, 138, 140, 146, 148, 150, 152, 154, 156 restrict movement of the walls with the floor more than fasteners 120, 122, 134, 136.

Figure 8:
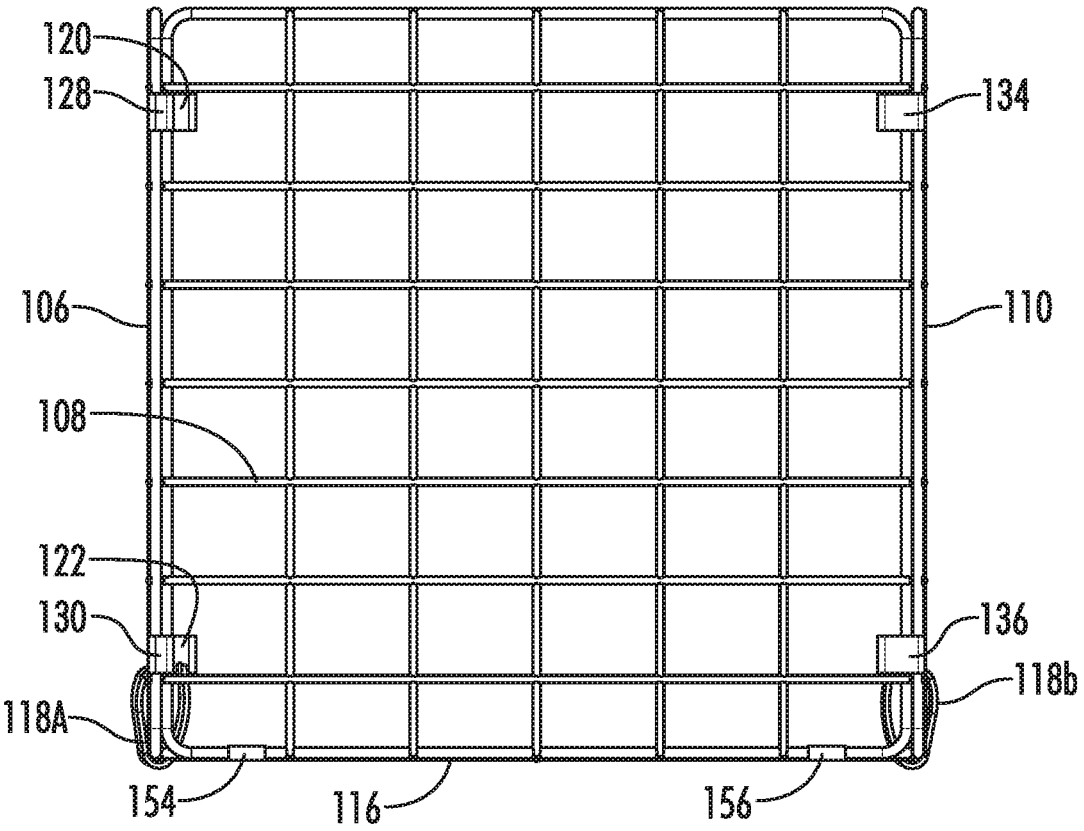
FIG. 8 is a front view thereof.

FIGS. 5-8 and 11-12 also show the attachment fingers 118A, 118B, 132A, 132B. Attachment fingers 118A, 118B, 132A, 132B adjustably attach to the container 100. In one embodiment, the attachment fingers 118, 132 pivotally attach to the container 100. The attachment fingers 118A, 118B, 132A, 132B curve upwards for insertion into the floor panels 114, 116 to maintain the positioning of the floor panels 114, 116 with the walls 102, 104, 106, 108, 110, 112 as shown in FIG. 8. The attachment fingers 118A, 118B, 132A, 132B inserted into the floor panels 114, 116 maintain the container 100 in the use position.

FIGS. 1, 7 and 9-11 show the adjustment of the container from the use position shown in FIG. 7 collapsing to the store position shown in FIG. 1. To collapse the container, the user detaches the attachment fingers 118A, 118B, 132A, 132B from the floor panels 114, 116. The user then lifts the floor panels 114, 116 at the attachment of the floor panels 114, 116 at fasteners 150, 152. Lifting the floor panels 114, 116 at the attachment at fasteners 150, 152 draws the opposite ends of floor panels 114, 116 toward each other.

Figure 9:
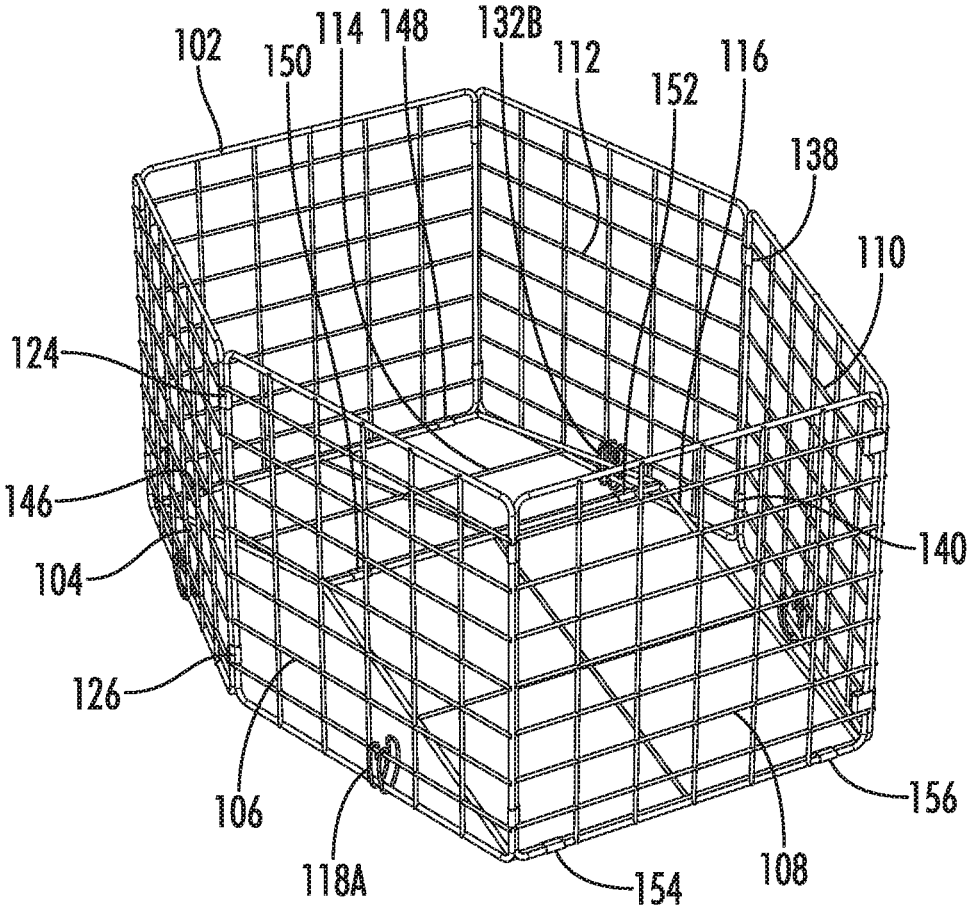
FIG. 9 is a perspective view thereof.
Figure 10:
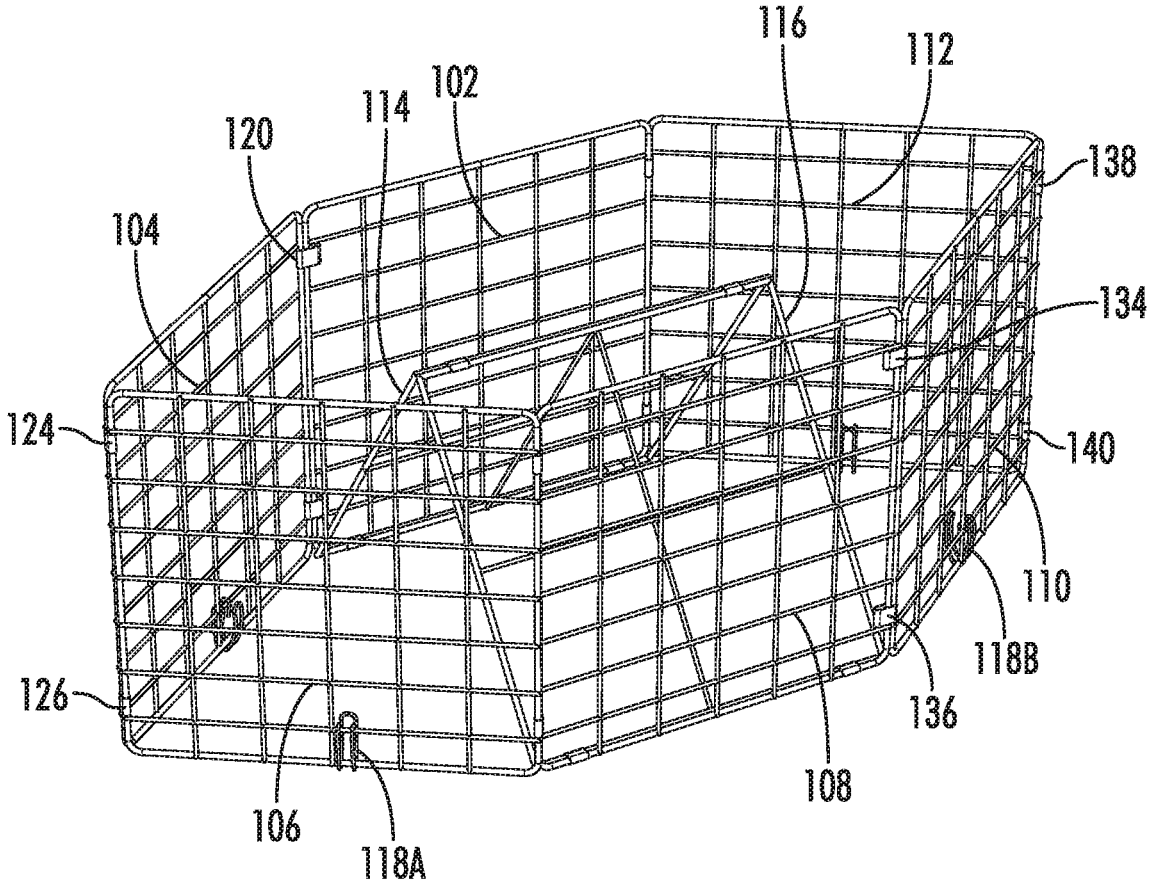
FIG. 10 is a perspective view thereof.

Collapsing the floor panels 114, 116 together draws the side walls 102, 108 toward each other. Collapsing the floor panels 114, 116 together also draws walls 104, 106 to each other and walls 110, 112 to each other as shown in FIGS. 9 and 10. Walls 104, 106 then pivot toward wall 108 in direction 158. Walls 110, 112, then pivot in the opposite direction 160 toward wall 102. The walls may pivot towards the alternative wall as long as walls 104, 106 pivot toward the opposite wall to which walls 110, 112 pivot.

Figure 11:
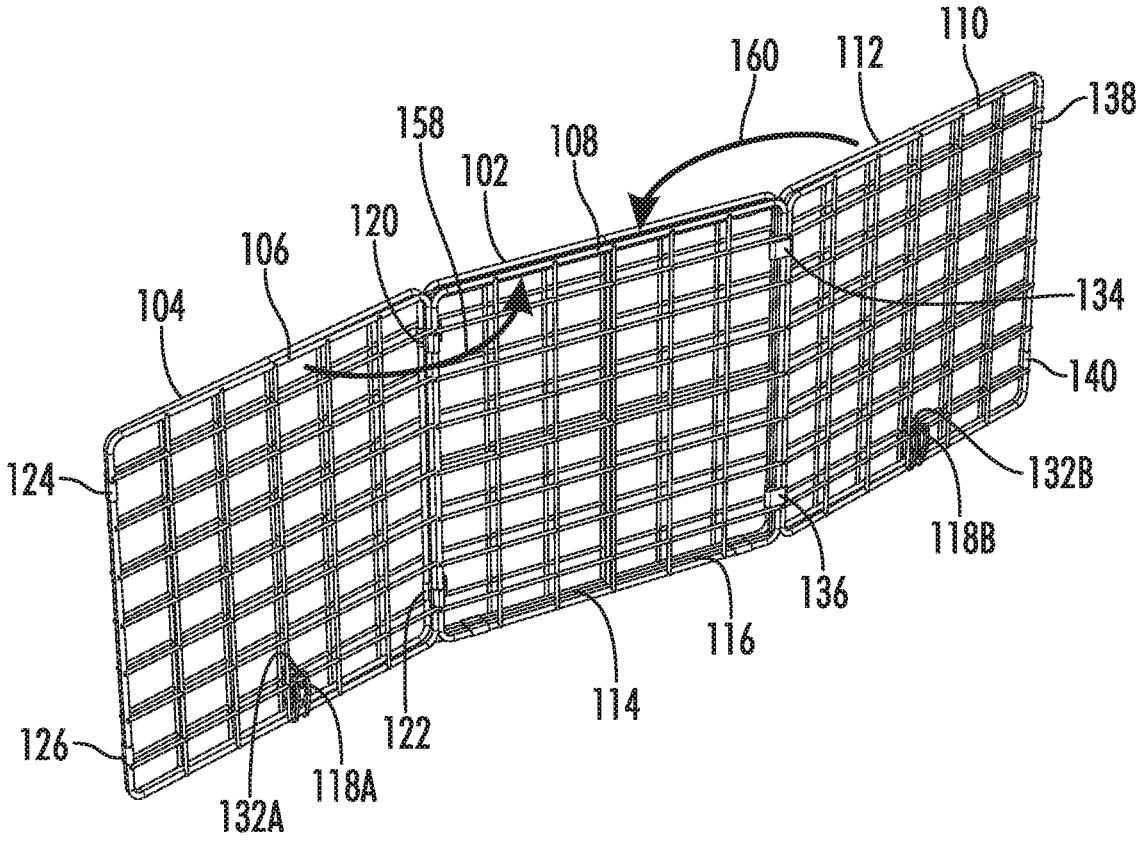
FIG. 11 is a perspective view thereof.

FIGS. 10-11 show the placement of the fasteners 120, 122 134, 136 that allow the pivoting of the walls 104, 106 and walls 110, 112. Fasteners 120, 122 are located opposite of the direction 158 to which walls 104, 106 pivot. Fasteners 134, 136 are located opposite of the direction 160 to which walls 110, 112 pivot. These fasteners 120, 122, 134, 136 allow pivot and the additional lateral movement needed to collapse the walls 104, 106, 110, 112 to a more compact storage position.

FIG. 11 shows the pivoting of the walls to collapse the container as shown in FIG. 1. The placement of the fasteners 120, 122, 134, 136 enable pivoting and adjustment of the walls to achieve the collapsed position shown in FIG. 1. Collapsing the container enables minimizing the space that the container occupies. The container then easily stores without occupying much space.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A collapsible container device comprising:

a first right wall;

a second right wall;

a first left wall;

a second left wall;

a front wall, wherein the front wall pivotally attaches to the first right wall and the first left wall;

a rear wall, wherein the rear wall pivotally attaches to the second right wall and the second left wall;

a first bottom panel that pivotally attaches to the front wall;

a second bottom panel that pivotally attaches to the rear wall, wherein the first bottom panel pivotally attaches to the second bottom panel;

a front right fastener that secures an attachment edge of the front wall with an attachment edge of the first right wall, wherein the front right fastener allows pivoting of the first right wall with the front wall, wherein the front right fastener also allows movement of the attachment edge of the front wall towards and away from the attachment edge of the first right wall for pivoting the second right wall against the rear wall;

a rear left fastener that secures an attachment edge of the rear wall with an attachment edge of the second left wall, wherein the rear left fastener allows pivoting of the second left wall with the rear wall, wherein the rear left fastener also allows movement of the attachment edge of the rear wall towards and away from the attachment edge of the second left wall for pivoting the first left wall against the front wall;

wherein the front right fastener and the rear left fastener are a first type of fastener that allows pivoting and the movement of the attachment edges;

wherein a second type of fastener pivotally attaches an attachment edge of the first right wall to an attachment edge of the second right wall, wherein the second type of fastener allows pivoting of the first right wall in relation to the second right wall, wherein the second type of fastener limits movement of the attachment edge of the first right wall towards and away from the attachment edge of the second right wall more than the first type of fastener, wherein the first type of fastener is different than the second type of fastener.

* * * * *